US011298960B2

(12) United States Patent
Kawajiri

(10) Patent No.: US 11,298,960 B2
(45) Date of Patent: Apr. 12, 2022

(54) PRINTER DEVICE AND CONTROL METHOD OF PRINTER DEVICE

(71) Applicant: SEIKO EPSON CORPORATION, Tokyo (JP)

(72) Inventor: Masahiro Kawajiri, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 36 days.

(21) Appl. No.: 16/890,191

(22) Filed: Jun. 2, 2020

(65) Prior Publication Data

US 2020/0376861 A1 Dec. 3, 2020

(30) Foreign Application Priority Data

Jun. 3, 2019 (JP) ..... JP2019-103522

(51) Int. Cl.
*B41J 11/00* (2006.01)

(52) U.S. Cl.
CPC ..... *B41J 11/0095* (2013.01)

(58) Field of Classification Search
CPC .... B41J 11/0095; B41J 3/4075; B41J 15/042; B41J 13/0009; B41J 15/04; B41J 29/393
See application file for complete search history.

(56) References Cited

FOREIGN PATENT DOCUMENTS

JP 2018-001487 1/2018

*Primary Examiner* — Jannelle M Lebron
(74) *Attorney, Agent, or Firm* — Workman Nydegger

(57) ABSTRACT

A printer device includes a transport mechanism that transports a continuous sheet in which a plurality of printing media are spaced apart from each other by a gap width and attached on a mount, a transmission sensor that detects transmittance of the continuous sheet, and a control unit that adjusts the transmission sensor. The control unit transports the continuous sheet in the +Y direction by using the transport mechanism, performs reverse transport control to transport the continuous sheet in the −Y direction by a reverse-feed distance that is greater than the gap by using the transport mechanism when the head position of a printing medium is detected by the transmission sensor, and adjusts the transmission sensor after the reverse transport control.

6 Claims, 8 Drawing Sheets

PRINTER DEVICE AND CONTROL METHOD OF PRINTER DEVICE

The present application is based on, and claims priority from JP Application Serial Number 2019-103522, filed Jun. 3, 2019, the disclosure of which is hereby incorporated by reference herein in its entirety.

BACKGROUND

1. Technical Field

The present disclosure relates to a printer device and a control method of the printer device.

2. Related Art

As disclosed in JP-A-2018-001487, for example, a printer device that performs printing on a continuous sheet formed of a mount and a plurality of printing media attached to the mount and that has a transmission-type optical sensor to detect the position of the printing medium on the mount is known. In such a type of printer device, addressing deterioration of a transmission-type optical sensor or a difference in transmittance between printing media requires the sensitivity of a transmission-type optical sensor to be adjusted in accordance with continuous sheet type.

For example, when a continuous sheet on which a black mark is printed is used, a detection value detected by a transmission-type optical sensor is lower when the print position of the black mark is detected than when the non-print position of the black mark is detected. Thus, there is a demand for a scheme to acquire a detection value used to adjust the sensitivity of a transmission-type optical sensor without having to detect the print position of a black mark.

SUMMARY

According to an aspect of the present disclosure, provided is a printer device including: a transport mechanism configured to transport, from a roll sheet including a continuous sheet being a wound form in a roll, the continuous sheet including a mount and a plurality of printing media attached to the mount and spaced apart from each other by a gap; a first detection unit including a first light-emitting unit configured to emit light to the continuous sheet and a first light-receiving unit configured to receive light transmitted through the continuous sheet; and a control unit configured to adjust the first detection unit, and the control unit configured to start transporting the continuous sheet in a transport direction, transport the continuous sheet in a direction opposite to the transport direction by a reverse-feed distance that is greater than the gap when a printing medium of the continuous sheet reaches a detection position of the first detection unit after the gap of the continuous sheet passes by the detection position of the first detection unit, and start adjusting the first detection unit after transporting the continuous sheet in the direction opposite to the transport direction.

According to another aspect of the present disclosure, provided is a control method of a printer device including a transport mechanism configured to transport, from a roll sheet including a continuous sheet being a wound form in a roll, the continuous sheet including a mount and a plurality of printing media attached to the mount and spaced apart from each other by a gap, and a first detection unit including a first light-emitting unit configured to emit light to the continuous sheet and a first light-receiving unit configured to receive light transmitted through the continuous sheet. The control method includes: starting transporting the continuous sheet in a transport direction; transporting the continuous sheet in a direction opposite to the transport direction by a reverse-feed distance that is greater than the gap when a printing medium of the continuous sheet reaches a detection position of the first detection unit after the gap of the continuous sheet passes by the detection position of the first detection unit; and starting adjusting the first detection unit after transporting the continuous sheet in the direction opposite to the transport direction.

DESCRIPTION OF EXEMPLARY EMBODIMENTS

Figure 1:
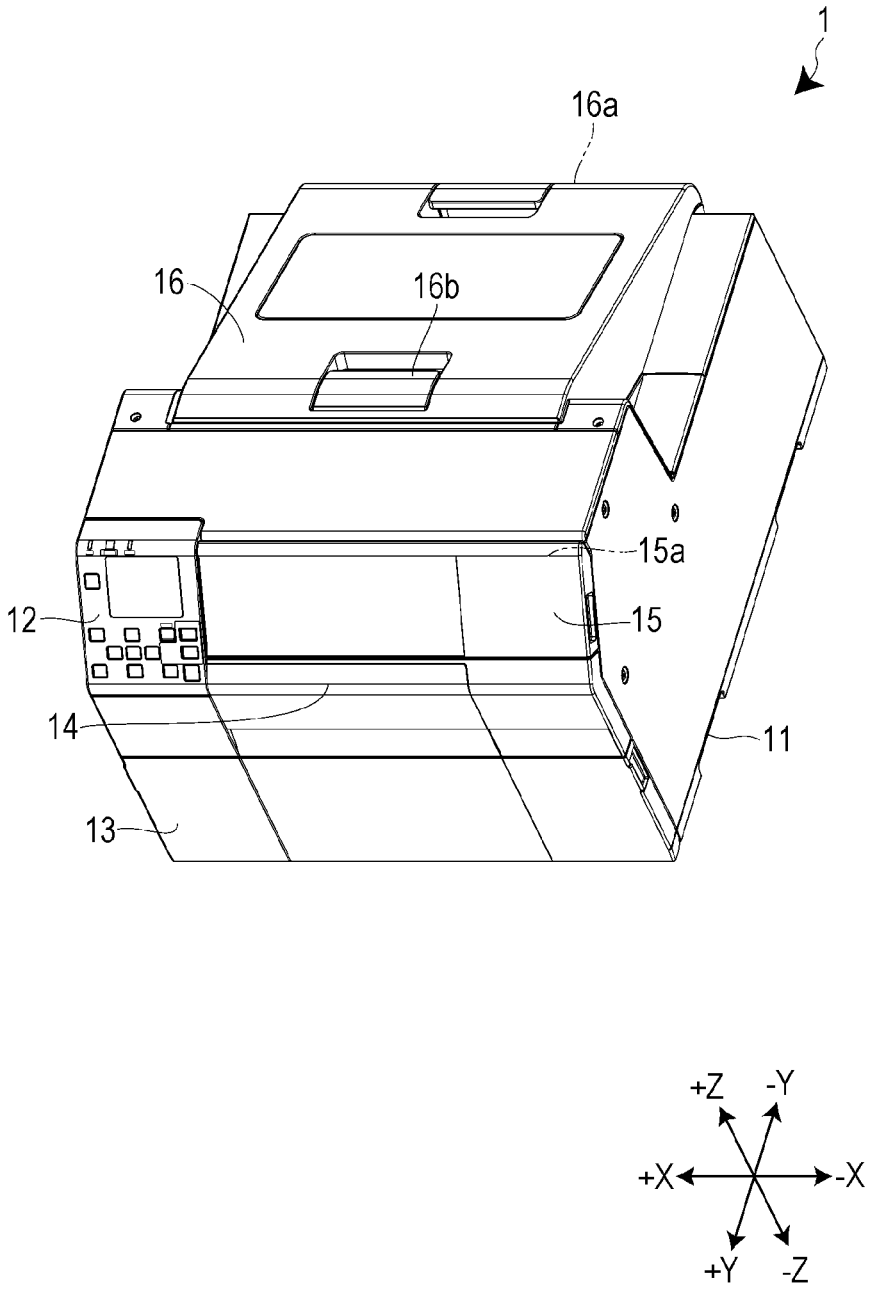
FIG. 1 is a perspective view illustrating the appearance of a printer device.

A printer device and a control method of the printer device in accordance with one embodiment will be described below with reference to the attached drawings. FIG. 1 to FIG. 5 are illustrations having an XYZ-coordinate system. The X direction corresponds to a primary scan direction of a print head 53 (see FIG. 4), which is the width direction of a continuous sheet 20 (see FIG. 2). Further, the Y direction corresponds to the depth direction of a printer device 1, which is the transport direction of the continuous sheet 20. Further, the Z direction corresponds to the perpendicular direction, which is the height direction of the printer device 1. Note that the XYZ-coordinate system is not necessarily required to be an orthogonal coordinate system and may be any coordinate system as long as three directions are orthogonal to each other.

Further, when the printer device 1 is viewed from the front, the left direction of the device is the +X direction, and the right direction of the device is the —X direction. Further, the front direction of the printer device 1 is the +Y direction, and the rear direction of the device is the −Y direction. Further, the upward direction of the printer device 1 is the +Z direction, and the downward direction of the device is the —Z direction.

First, an overview of the printer device 1 will be described. The printer device 1 performs printing on printing media 22 attached to the continuous sheet 20 in an ink jet scheme in accordance with print data transmitted from an information processing device such as a personal computer (PC). Further, the printer device 1 performs transport control of the continuous sheet 20 in accordance with a result of detection performed by a detection mechanism 70 (see FIG.

4) including a transmission-type optical sensor 73. The transmission-type optical sensor 73 will be referred to as a transmission sensor.

Further, to address deterioration of the transmission sensor 73 or a difference in transmittance between printing media 22, the printer device 1 performs calibration to adjust the sensitivity of the transmission sensor 73. The transmission sensor 73 is an example of a first detection unit. Note that adjusting the sensitivity of the transmission sensor 73 is performed by matching a printing medium 22 to a detecting position of the transmission sensor 73. This is because, since transmittance differs due to a difference in the thickness or the paper type of the printing media 22, the optimal sensitivity of the transmission sensor 73 is required to be determined by irradiating respective printing media 22 with light.

Next, the appearance of the printer device 1 will be described with reference to FIG. 1. As illustrated in FIG. 1, the printer device 1 has a substantially rectangular device casing 11. A display/operation panel 12 on which a display and various buttons are arranged is provided on the device front face of the device casing 11. Further, a pull-out-type ink cartridge replacement port 13 is provided in the —Z direction of the display/operation panel 12.

Further, the front face cover 15 is provided in the —X direction of the display/operation panel 12 on the device front face of the device casing 11. The front face cover 15 can be rotated about a first hinge 15*a* installed at the end of the front face cover 15 in the +Z direction. When the front face cover 15 is opened, the print mechanism 50 (see FIG. 4) is exposed. The user may remove a paper jam of the continuous sheet 20 by opening the front face cover 15.

Further, a discharge port 14 is provided in the —Z direction of the front face cover 15 on the device front face of the device casing 11. The continuous sheet 20 on which printing has been performed by the print mechanism 50 and which has been cut into a strip shape by a cutting mechanism 60 (see FIG. 4) is discharged from the discharge port 14.

Further, a top face cover 16 is provided in substantially half of the device top face of the device casing 11 in the −Y direction. The top face cover 16 can be rotated about a second hinge 16*a* installed at the end of the top face cover 16 in the −Y direction. When the top face cover 16 is opened, a roll sheet accommodation unit 30 (see FIG. 4) is exposed. The user may load a roll sheet 100 (see FIG. 4) by unlocking a closure lock 16*b* of the top face cover 16 installed in the +Y direction and opening the top face cover 16. The roll sheet 100 is the continuous sheet 20 wound in a roll around a sheet tube 33 as a core.

Figure 2:
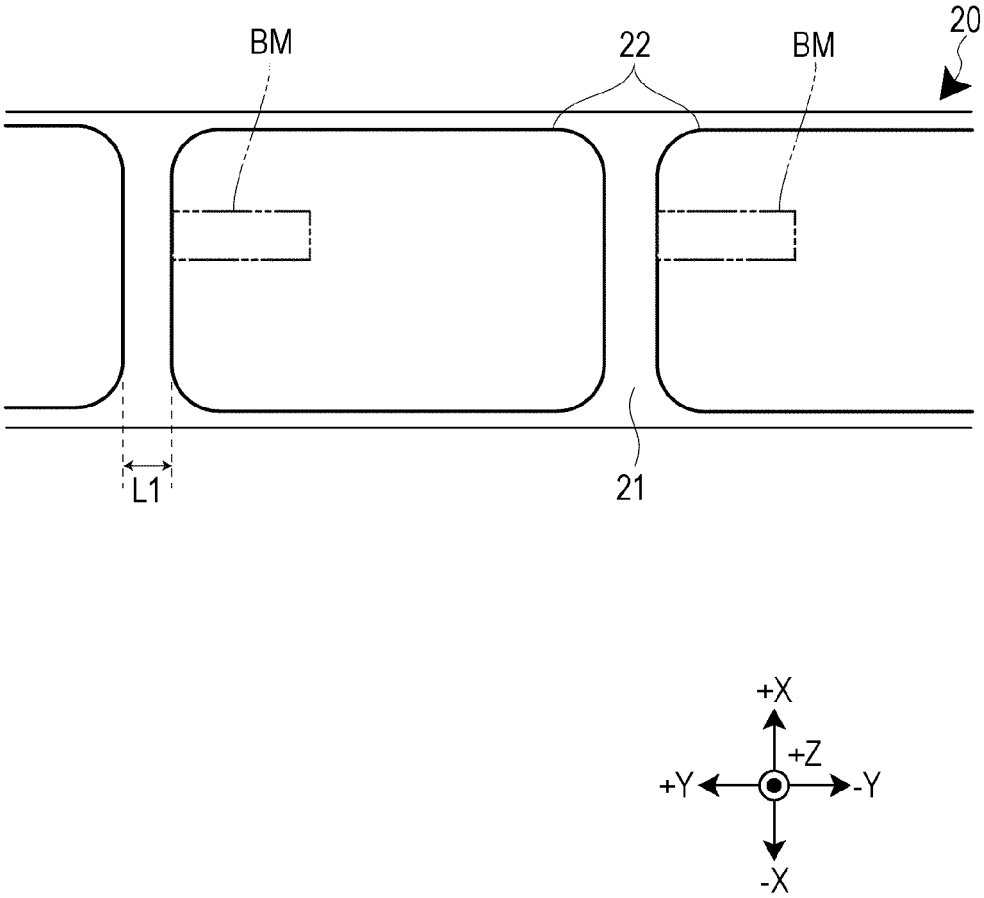
FIG. 2 is a diagram of a continuous sheet when viewed from the +Z direction.
Figure 3:
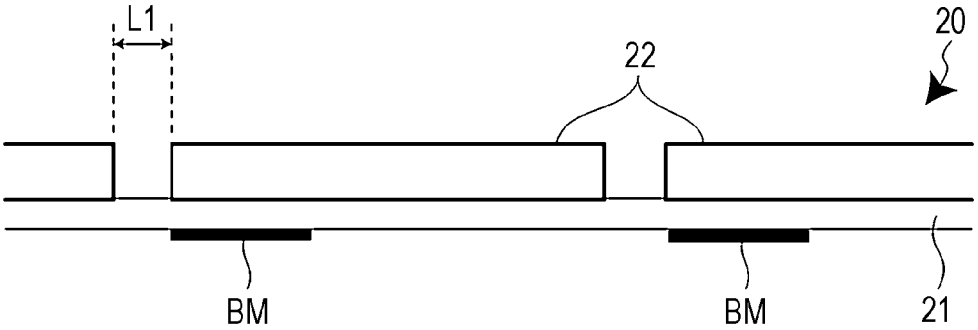
FIG. 3 is a diagram of a continuous sheet when viewed from the −X direction.
Figure 3:
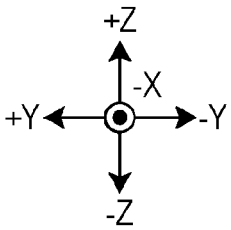

Next, the configuration of the continuous sheet 20 will be described with reference to FIG. 2 and FIG. 3. FIG. 2 is a diagram of the continuous sheet 20 when viewed from the +Z direction, and FIG. 3 is a diagram of the continuous sheet 20 when viewed from the −X direction. As illustrated in both FIG. 2 and FIG. 3, the continuous sheet 20 has a belt-shaped mount 21 and a plurality of printing media 22. The plurality of printing media 22 are spaced apart from each other by a fixed gap and attached to the front side of the mount 21, that is, the face of the mount 21 viewed from the +Z direction. The printing media 22 may be labels, for example. Note that the width of a gap in the Y direction of the adjacent printing media 22 is denoted as a gap width L1.

Further, black marks BM each indicating a head position of the printing medium 22 in the transport direction of the continuous sheet 20, that is, in the +Y direction are printed on the backside of the mount 21, that is, the face of the mount 21 viewed from the —Z direction. Therefore, the head position of the printing medium 22 in the +Y direction and the head position of the black mark BM are the same. Note that the head position of the printing medium 22 and the head position of the black mark BM are not necessarily required to be the same and may be different from each other.

The printing medium 22 can be removed from the mount 21. Further, multiple types of continuous sheets 20 may be prepared. For example, the continuous sheets 20 that differ from the mount 21 or the printing media 22 in width, material, thickness, or the like may be prepared. Further, the continuous sheets 20 that differ in gap width L1 or in the length of the black mark BM in the Y direction may be prepared. However, the length in the Y direction of the black mark BM is less than the length of the printing medium 22 in the Y direction. Further, in the arrangement of the black marks BM in the X direction, a printing range is defined with respect to the end in the +X direction of the mount 21 as a reference.

Figure 4:
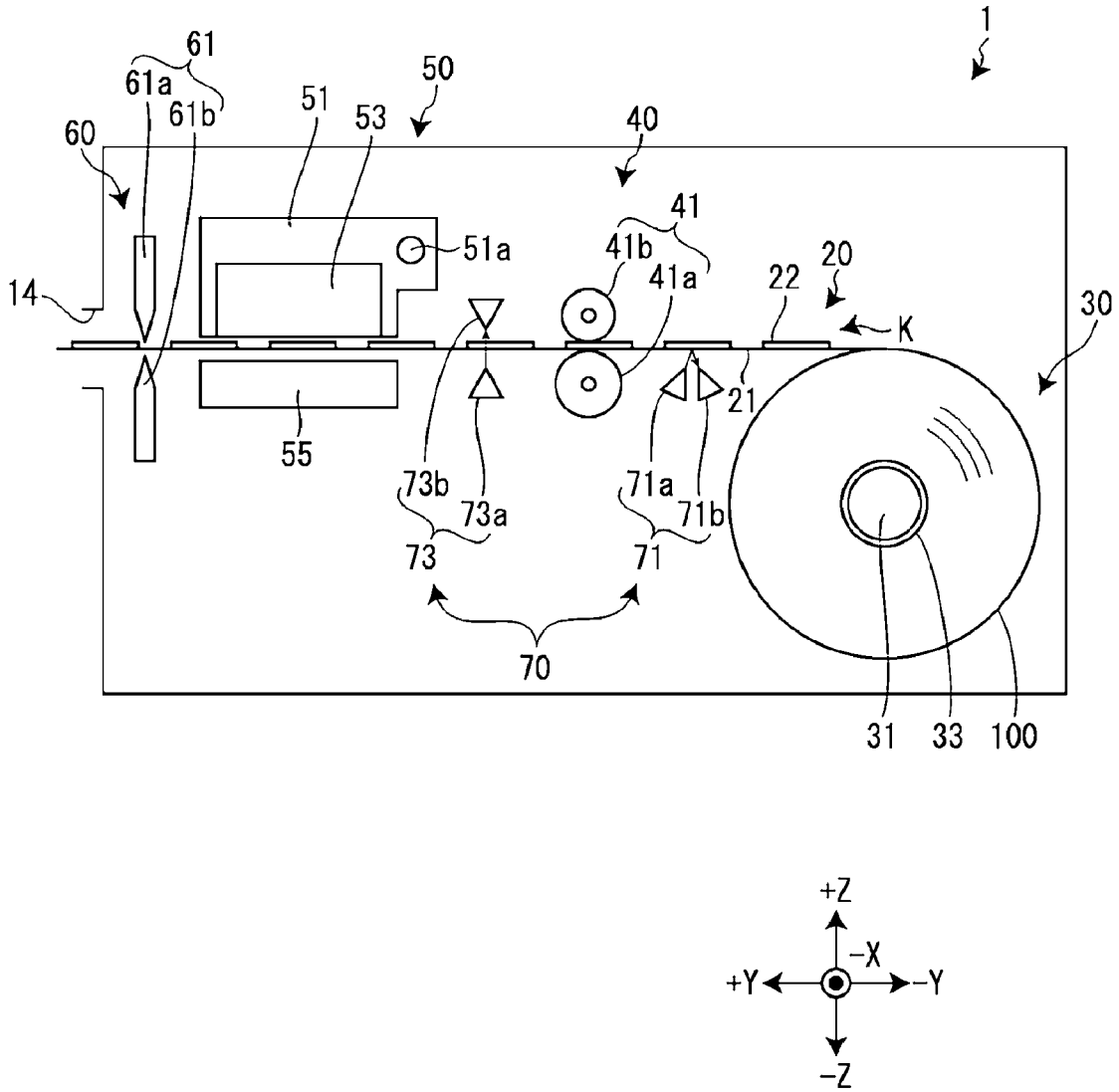
FIG. 4 is a schematic diagram illustrating a transport path and the periphery thereof in the printer device.
Figure 5:
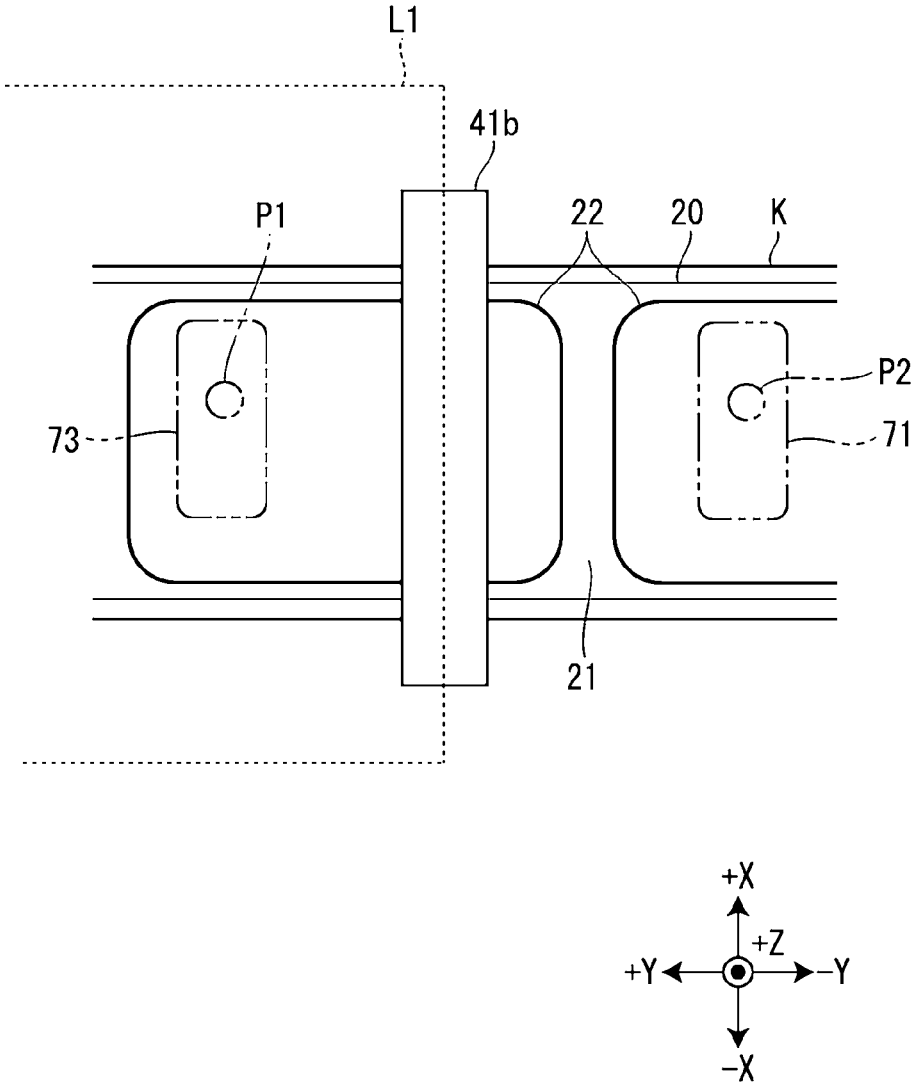
FIG. 5 is a schematic diagram illustrating a transmission sensor and a reflection sensor.

Next, with reference to FIG. 4 and FIG. 5, the internal configuration of the printer device 1 will be described. FIG. 4 is a schematic sectional view of a transport path K when viewed from the −X direction, and FIG. 5 is a plan view of the transport path K when viewed from the +Z direction. As illustrated in FIG. 4, the printer device 1 has the roll sheet accommodation unit 30, the transport mechanism 40, the print mechanism 50, and the cutting mechanism 60.

The roll sheet accommodation unit 30 has a roll sheet loading unit 31. The sheet tube 33 of the roll sheet 100 is loaded in the roll sheet loading unit 31. The roll sheet 100 rotates in accordance with rotation of the roll sheet loading unit 31, the continuous sheet 20 is fed out in response to the rotation. In the example illustrated in FIG. 4, when the continuous sheet 20 is fed out, the roll sheet 100 is rotated counterclockwise.

The transport mechanism 40 has a transport roller 41 used for transporting the continuous sheet 20 along the transport path K. The transport roller 41 is arranged upstream of the print head 53 in the transport direction of the continuous sheet 20. The transport roller 41 includes a transport driving roller 41*a*, which is driven and rotated by motive power being transferred from a drive source (not illustrated) such as a transport motor, and a transport driven roller 41*b*, which is rotated in response to the rotation of the transport driving roller 41*a*.

Note that the transport roller 41 can transport the continuous sheet 20 not only in the forward direction, that is, the +Y direction, but also in the reverse direction, that is, the −Y direction. Note that the printer device 1 in accordance with the present embodiment employs a serial print scheme and thus transports the continuous sheet 20 intermittently rather than continuously at a fixed rate.

The print mechanism 50 is arranged downstream of the transport mechanism 40 in the transport direction of the continuous sheet 20 and has a carriage 51, the print head 53, and a platen 55. The print head 53 is a serial-type ink jet head mounted on the carriage 51. Further, the platen 55 is arranged facing the print head 53 across the transport path K.

The carriage 51 is supported by a carriage shaft 51*a* extending in the primary scan direction, that is, the X direction crossing the transport direction of the continuous sheet 20. The carriage 51 reciprocates in the primary scan direction along the carriage shaft 51*a* and thereby scans the print head 53.

The print head 53 has nozzle lines corresponding to a plurality of colors such as cyan, yellow, magenta, black, or the like. In response to ink being supplied from each ink cartridge for a corresponding color, the print head 53 discharges the ink from a nozzle provided to each nozzle line. The ink discharged from a nozzle lands on the printing medium 22 of the continuous sheet 20, and an image is formed on the printing medium 22.

In the platen 55, a plurality of suction holes are formed in the upper face, and each of the suction holes communicates with a suction fan (not illustrated). Accordingly, since the continuous sheet 20 is transported while being adhered by suction to the upper face of the platen 55, it is possible to suppress the continuous sheet 20 from interfering with the nozzle face of the print head 53.

The cutting mechanism 60 is arranged downstream of the print mechanism 50 in the transport direction of the continuous sheet 20 and has an automatic cutter 61 configured to cut the continuous sheet 20. The automatic cutter 61 includes a movable blade 61*a* (first blade), which is driven by motive power being transferred from a drive source (not illustrated) having a cutter motor or the like, and a fixed blade 61*b* (second blade), which is arranged facing the movable blade 61*a* across the transport path K. The cutting mechanism 60 cuts a printed portion of the continuous sheet 20 into pieces of predetermined lengths.

In accordance with the configuration described above, the printer device 1 uses the transport mechanism 40 to transport the continuous sheet 20 fed out from the roll sheet accommodation unit 30 along the transport path K. Further, the print mechanism 50 performs printing on the continuous sheet 20 being transported on the transport path K, and the cutting mechanism 60 cuts the continuous sheet 20 into predetermined lengths. The strip-shape continuous sheet 20 cut by the cutting mechanism 60 is discharged from the discharge port 14.

On the other hand, as illustrated in FIG. 4 and FIG. 5, the printer device 1 has the detection mechanism 70 including two types of optical sensors facing the transport path K. The detection mechanism 70 includes a reflection-type optical sensor 71 and a transmission sensor 73. The reflection-type optical sensor 71 will be referred to as a reflection sensor. The reflection sensor 71 is an example of a second detection unit.

The reflection sensor 71 is arranged upstream of the transport roller 41 in the transport direction of the continuous sheet 20. Further, the reflection sensor 71 has a reflection sensor light-emitting unit 71*a*, which emits light from the —Z direction onto the continuous sheet 20 conveyed on the transport path K, and a reflection sensor light-receiving unit 71*b*, which receives light reflected by the continuous sheet 20. The reflection sensor light-emitting unit 71*a* is an example of a second light-emitting unit, and the reflection sensor light-receiving unit 71*b* is an example of a second light-receiving unit.

The transmission sensor 73 is arranged downstream of the transport roller 41 in the transport direction of the continuous sheet 20. Further, the transmission sensor 73 has a transmission sensor light-emitting unit 73*a*, which emits light from the —Z direction onto the continuous sheet 20 conveyed on the transport path K, and a transmission sensor light-receiving unit 73*b*, which receives light transmitted through the continuous sheet 20. The transmission sensor light-emitting unit 73*a* is an example of a first light-emitting unit, and the transmission sensor light-receiving unit 73*b* is an example of a first light-receiving unit.

The reflection sensor 71 is an optical sensor used for detecting the position of the black mark BM. That is, the reflection sensor 71 emits light to the continuous sheet 20 transported on the transport path K and detects whether or not the black mark BM is present at a second detection position P2 that is a detection position of the reflection sensor 71. When the detection value from the reflection sensor 71 is lower than a predefined second threshold, a control unit 110 described later (see FIG. 6) determines that the black mark BM is present at the second detection position P2.

In contrast, the transmission sensor 73 is an optical sensor used for detecting the position of the printing medium 22. That is, the transmission sensor 73 emits light to the continuous sheet 20 transported on the transport path K and detects whether or not the printing medium 22 is present at a first detection position P1 that is a detection position of the transmission sensor 73. When the detection value from the transmission sensor 73 is lower than a predefined first threshold, the control unit 110 described later determines that the printing medium 22 is present at the first detection position P1.

Note that the transmission sensor light-receiving unit 73*b* in the transmission sensor 73 is not covered with the continuous sheet 20 and is thus likely to be affected by being exposed to light when the top face cover 16 of the printer device 1 is opened. In this regard, as illustrated in FIG. 5, the transmission sensor 73 is arranged in a portion not exposed when the top face cover 16 (see FIG. 1) is opened. In FIG. 5, the virtual line L1 indicates a region shielded from light by the device casing 11 when the top face cover 16 (see FIG. 1) is opened. In such a way, the transmission sensor 73 is arranged at a position less affected by light and is thus not affected by light due to opening and closing of the device casing 11.

On the other hand, the reflection sensor 71 is arranged in a portion exposed when the top face cover 16 is opened. However, the reflection sensor light-emitting unit 71*a* and the reflection sensor light-receiving unit 71*b* are arranged below the transport path K, that is, in the —Z direction of the transport path K, and the reflection sensor 71 is mostly covered with the continuous sheet 20 and is thus not affected by light, even when the top face cover 16 is opened.

Note that, on the transport path K, the continuous sheet 20 is transported with respect to the end in the +X direction of the transport path K as a reference regardless of sheet width. That is, the continuous sheet 20 is transported in the Y direction while guided by a fixed guide (not illustrated) provided at the end in the +X direction of the transport path K and a movable guide (not illustrated) configured to move in the X direction in accordance with the sheet width of the continuous sheet 20.

Thus, the first detection position P1, which is the detection position of the transmission sensor 73, is set at a position at which the printing medium 22 having the minimum sheet width applicable to the printer device 1 can be detected. Further, the second detection position P2, which is the detection position of the reflection sensor 71, is set at a position at which the black mark BM can be detected. To satisfy these conditions, the reflection sensor 71 and the transmission sensor 73 are arranged at substantially the same position in the width direction of the continuous sheet 20, that is, in the X direction.

Figure 6:
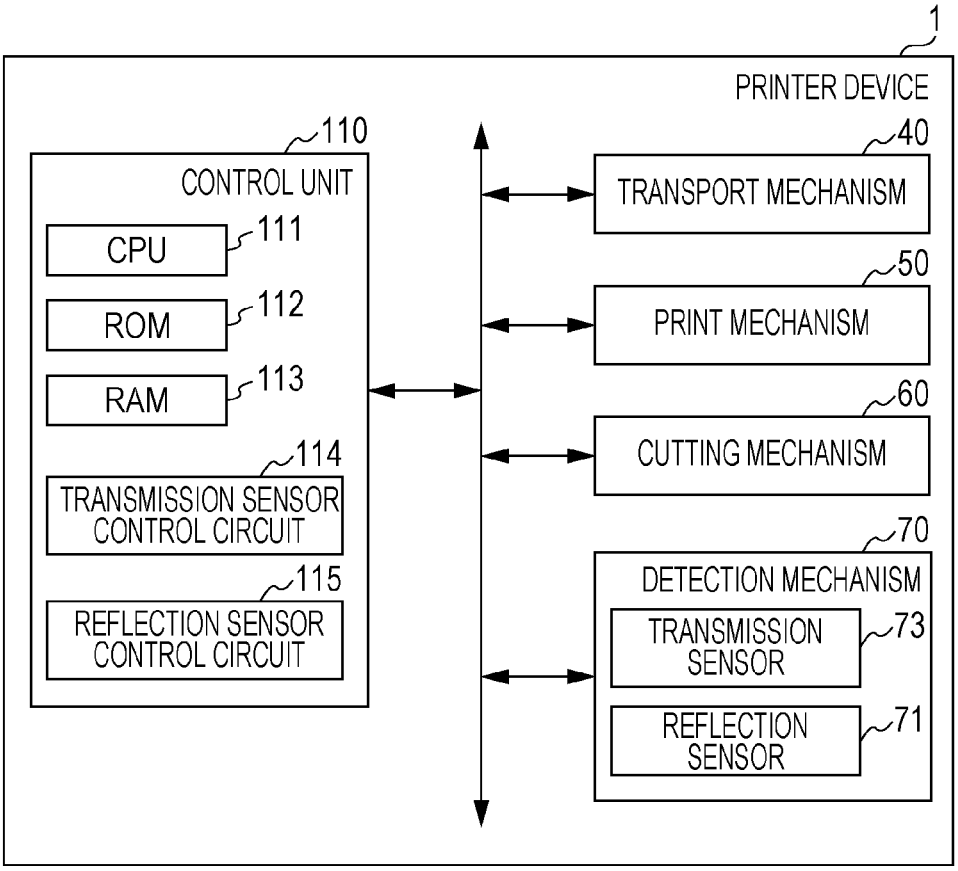
FIG. 6 is a block diagram illustrating a control configuration of the printer device.

Next, with reference to FIG. 6, the control configuration of the printer device 1 will be described. The printer device 1 has the control unit 110, the transport mechanism 40, the print mechanism 50, the cutting mechanism 60, and the detection mechanism 70.

The control unit 110 includes a central processing unit (CPU) 111, which is an example of a processor, a read-only memory (ROM) 112, a random access memory (RAM) 113, a transmission sensor control circuit 114, and a reflection sensor control circuit 115. The CPU 111 controls each component in the printer device 1 by reading a control program such as a firmware program stored in the ROM 112 and loading the read control program to the RAM 113.

The control program includes a calibration program used to adjust the sensitivity of the transmission sensor 73. Adjusting the sensitivity of the transmission sensor 73 is an example of adjusting the first detection unit.

Note that a processor other than the CPU 111 may be used in the control unit 110. The processor may be a hardware circuit such as an application specific integrated circuit (ASIC), for example. Further, in the processor, hardware circuits such as one or more ASICs and one or more CPUs may operate in cooperation.

The transmission sensor control circuit 114 includes an amplifier circuit that amplifies the output of the transmission sensor light-receiving unit 73*b*, a digital potentiometer that controls an amplification factor of the amplifier circuit, an analog-to-digital (AD) convertor circuit that converts the output of the amplifier circuit to a digital signal, or the like. In the present embodiment, the CPU 111 adjusts the sensitivity of the transmission sensor 73 by changing the amplification factor of the amplifier circuit by using a digital potentiometer.

Similarly, the reflection sensor control circuit 115 includes an amplifier circuit that amplifies the output of the reflection sensor light-receiving unit 71*b*, a digital potentiometer that controls an amplification factor of the amplifier circuit, an AD convertor circuit that converts the output of the amplifier circuit to a digital signal, or the like. In the present embodiment, the sensitivity of the reflection sensor 71 is not adjusted.

The transport mechanism 40 includes, for example, a transport motor that is a drive source of the transport roller 41 in addition to the transport roller 41 described above. The print mechanism 50 includes a carriage motor that is a drive source of the carriage 51, a head drive mechanism that drives the print head 53, or the like in addition to the carriage 51, the print head 53, and the platen 55 described above. The cutting mechanism 60 includes a cutter motor that is a drive source of the automatic cutter 61 in addition to the automatic cutter 61 described above.

The detection mechanism 70 includes the transmission sensor 73 and the reflection sensor 71, as described above. Note that each of the transmission sensor light-emitting unit 73*a* and the reflection sensor light-emitting unit 71*a* has a light-emitting diode, for example. Further, each of the transmission sensor light-receiving unit 73*b* and the reflection sensor light-receiving unit 71*b* has a phototransistor, for example.

Next, calibration to adjust the sensitivity of the transmission sensor 73 will be described with reference to FIG. 7 and FIG. 8. Once starting calibration, the control unit 110 first transports the continuous sheet 20 in the +Y direction by using transport mechanism 40. In response to the transmission sensor 73 detecting the head position of the printing medium 22, the control unit 110 performs reverse transport control to transport the continuous sheet 20 in the −Y direction by a reverse-feed distance exceeding the gap width L1 (see FIG. 2) of the printing medium 22. After the reverse transport control, the control unit 110 then adjusts the sensitivity of the transmission sensor 73.

Figure 7:
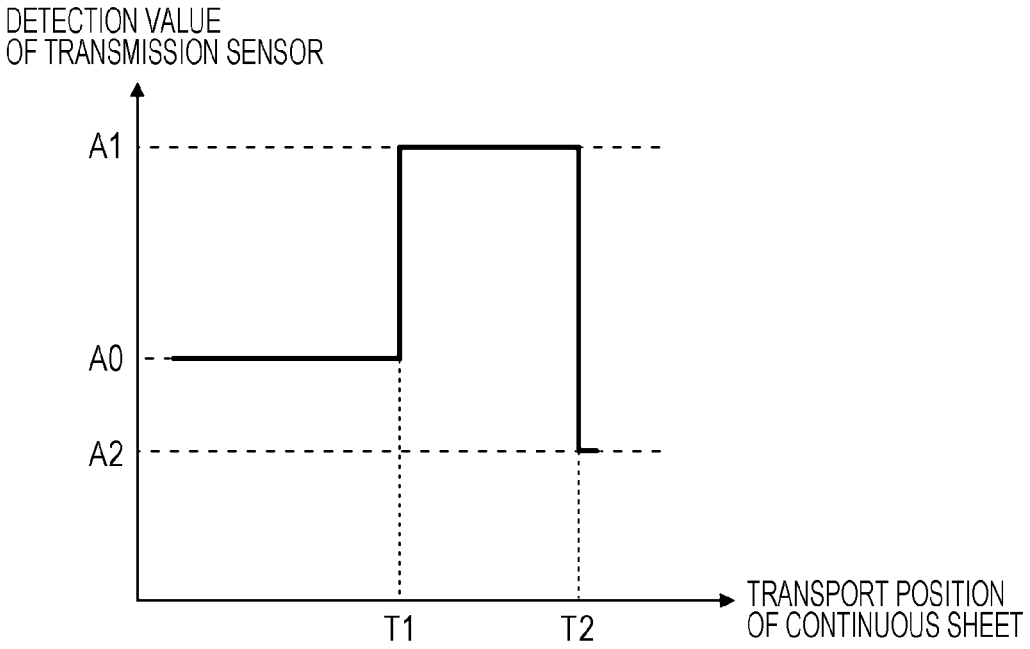
FIG. 7 is a graph illustrating a relationship between a transporting position of a continuous sheet and a detection value of a transmission sensor.

Description will be provided in more detail with reference to the graph of FIG. 7. In the graph of FIG. 7, the horizontal axis represents the transport position of the continuous sheet 20, and the vertical axis represents the detection value of the transmission sensor 73. FIG. 7 illustrates that the transmission sensor 73 detects a portion in which the printing medium 22 overlaps a non-black mark print position of the mount 21 after transport is started in the +Y direction and before the continuous sheet 20 reaches the transport position T1, that the transmission sensor 73 detects a portion of only the mount 21 when the continuous sheet 20 moves from the transport position T1 to the transport position T2, and that the transmission sensor 73 detects a portion in which the printing medium 22 overlaps a black mark print position of the mount 21 after the continuous sheet 20 reaches the transport position T2 and moves on.

In such a case, the detection value A1 of the transmission sensor 73 for the transport position from T1 to T2 is larger than the detection value A0 of the transmission sensor 73 for the transport position from the start to T1. This is because, since only the mount 21 is irradiated with light for the transport position from T1 to T2, the light transmittance is higher than that from light irradiation before the transport position reaches T1. In other words, when the portion of only the mount 21 passes by the first detection position P1 of the transmission sensor 73, the detection value of the transmission sensor 73 is the detection value A1. The portion of only the mount 21 corresponds to the gap on the continuous sheet 20. Further, the detection value A2 of the transmission sensor 73 obtained after the transport position reaches T2 is smaller than the detection value A0 and the detection value A1. This is because, since the printing medium 22, the mount 21, and the black mark BM are irradiated with light after the transport position reaches T2, the light transmittance is lower than that from light irradiation for the transport position from the start to T2. In other words, when the black mark BM passes by the first detection position P1 of the transmission sensor 73, the detection value of the transmission sensor 73 is the detection value A2. Note that the detection value A1 is one example of the first detection value, and the detection value A2 is one example of the second detection value.

In such a way, in response to detection of a portion in which the black mark BM is printed, the light transmittance decreases significantly due to the black mark BM. Thus, to accurately adjust the sensitivity of the transmission sensor 73, detecting the print position of the black mark BM on the printing medium 22 is to be avoided so that adjustment may be performed.

It appears to be possible to detect the position of the black mark BM by using the reflection sensor 71, utilize the detection result, avoid detecting the print position of the black mark BM, and perform detection by using the transmission sensor 73. To reliably avoid detecting the position of the black mark BM, it is preferable that the reflection sensor 71 and the transmission sensor 73 be arranged at the same position in the Y direction. As described above, however, it is not possible to arrange two types of optical sensors, namely, the reflection sensor 71 and the transmission sensor 73 to be aligned in the X direction to enable detection when the printing medium 22 is narrow. Further, since the printing position in the X direction of the black mark BM is set flexibly, it is not useful to set the first detection position P1, which is the detection position of the transmission sensor 73, to a position offset from the print position of the black mark BM.

Thus, in the present embodiment, only the transmission sensor 73 is used to avoid detecting the print position of the black mark BM and adjust the sensitivity of the transmission sensor 73 without use of the reflection sensor 71.

Figure 8:
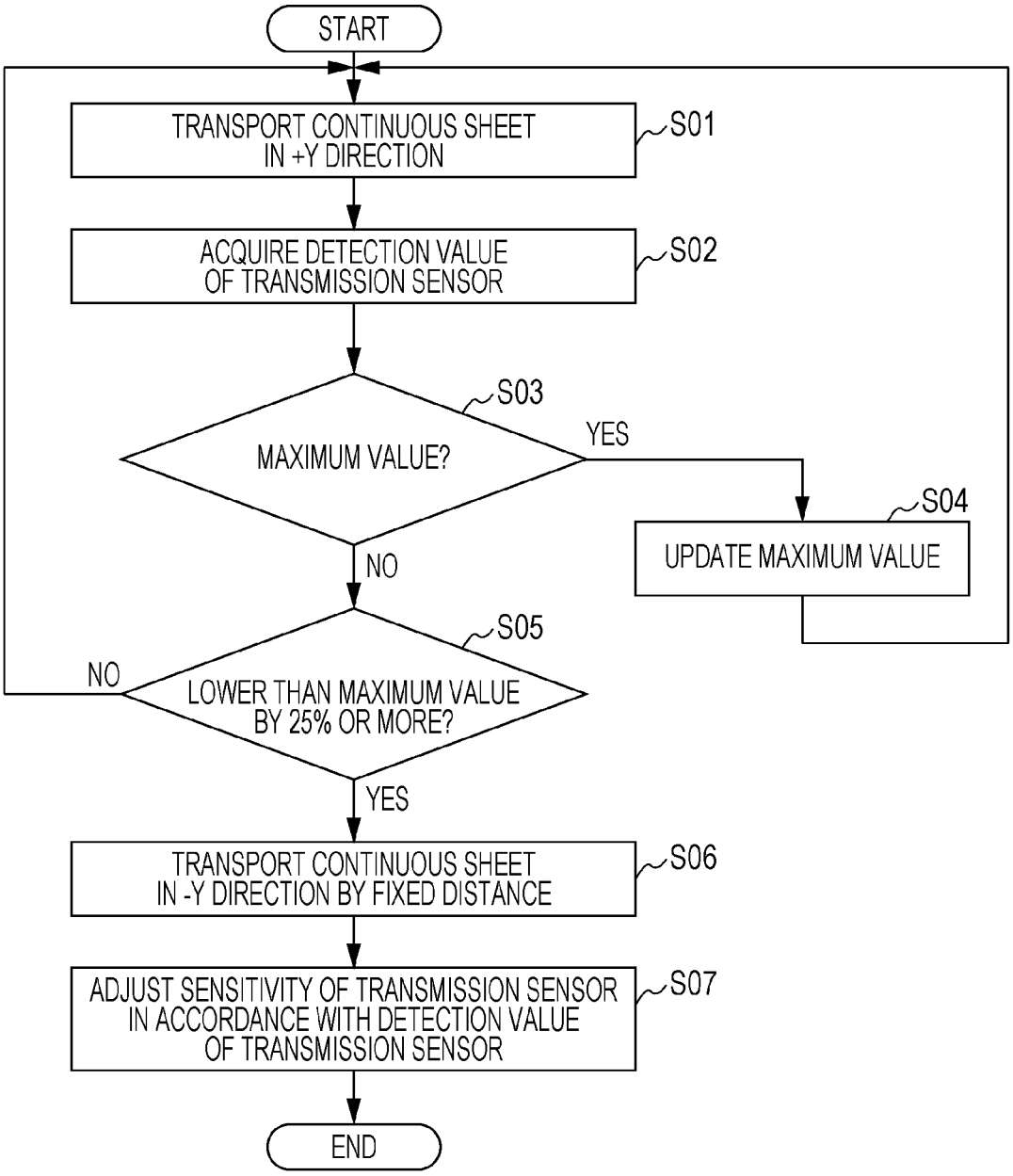
FIG. 8 is a flowchart illustrating a flow of calibration performed by the printer device.

FIG. 8 is a flowchart illustrating a flow of calibration including adjusting the sensitivity of the transmission sensor 73. First, the control unit 110 transports the continuous sheet 20 in the +Y direction (S01) and acquires the detection value of the transmission sensor 73 (S02). The control unit 110 determines whether or not the largest detection value is acquired after transport of the continuous sheet 20 in the +Y direction is started (S03). Hereafter, the largest detection value of the detection values acquired after transport of the continuous sheet 20 in the +Y direction is started is referred to as the maximum value. The maximum value is stored in a predetermined storage area provided in the RAM 113 or the like.

If the control unit 110 determines that the maximum value is acquired after transport of the continuous sheet 20 in the +Y direction is started (S03: Yes), the control unit 110 updates the maximum value in the predetermined storage area (S04), and the process returns to step S01. On the other hand, if the control unit 110 determines that the maximum value is not acquired after transport of the continuous sheet 20 in the +Y direction is started (S03: No), the control unit 110 determines whether or not a detection value which is lower by 25% or more than the maximum value stored in the predetermined storage area in step S02 (S05) is acquired.

If the control unit 110 determines that no detection value which is lower than the maximum value by 25% or more is acquired (S05: No), the process returns to step S01. On the other hand, if the control unit 110 determines that a detection value which is lower than the maximum value by 25% or more is acquired (S05: Yes), the control unit 110 assumes that the head position of the printing medium 22 is detected and starts reverse transport control. In other words, when the printing medium 22 of the continuous sheet 20 reaches the first detection position P1 of the transmission sensor 73, reverse transport control is started. That is, if the control unit 110 determines that a detection value which is lower than the maximum value by 25% or more is acquired (S05: Yes), the control unit 110 transports the continuous sheet 20 in the −Y direction by a fixed distance (S06). The fixed distance is one example of a reverse-feed distance. Note that the term "reach" represents a concept including an operation of at least a part of the printing medium 22 of the continuous sheet 20 overlapping the first detection position P1 of the transmission sensor 73 and is not required to be construed in a strict sense.

Herein, the fixed distance is set to a distance that is slightly greater than the gap width L1, for example, a distance obtained by adding several millimeters to the gap width L1. Note that, since the gap width L1 is flexibly set in accordance with the type of the continuous sheet 20, the fixed distance is set to be slightly greater than the largest gap width L1 in multiple types of continuous sheets 20 supported by the printer device 1. Accordingly, by transporting the continuous sheet 20 in the −Y direction by a fixed distance exceeding the gap width L1, it is possible to cause a part near the rear end of the printing medium 22 to face the detection position of the transmission sensor 73. In other words, the detection position of the transmission sensor 73 and the region without the black mark BM on the printing medium 22 are matched.

After performing the reverse transport control of step S07, the control unit 110 acquires the detection value of the transmission sensor 73 and adjusts the sensitivity of the transmission sensor 73 in accordance with the acquired detection value (S07). Specifically, the digital potentiometer in the transmission sensor control circuit 114 is adjusted so that the detection value of the transmission sensor 73 is within a predetermined range.

As described above, during calibration, the printer device 1 according to the present embodiment transports the continuous sheet 20 in the +Y direction, performs reverse transport control to transport the continuous sheet 20 in the −Y direction by a fixed distance that is greater than the gap width L1 when the head position of the printing medium 22 is detected by the transmission sensor 73, and adjusts the transmission sensor 73 after the reverse transport control.

With such a configuration, it is possible to adjust the sensitivity of the transmission sensor 73 in accordance with the detection value acquired at the rear end of the printing medium 22 while avoiding detecting the printed portion of the black mark BM of the continuous sheet 20. That is, even when the continuous sheet 20 on which the black mark BM is printed is used, the sensitivity of the transmission sensor 73 can be accurately adjusted. Further, it is possible to flexibly set the length of the black mark BM of the continuous sheet 20 to be used.

Further, detection by using the reflection sensor 71 is not required to avoid detecting a portion on which the black mark BM is printed, the flexibility in the arrangement of the reflection sensor 71 may be increased. Further, the first detection position P1, which is the detection position of the transmission sensor 73, and the print position of the black mark BM on the mount 21 can be overlapped in the X direction, the flexibility in the arrangement of the transmission sensor 73 may also be increased.

Note that the embodiment described above is to merely illustrate one aspect of the present disclosure, and the specific aspect of the present disclosure and the applicable scope of the present disclosure are not limited to the embodiment described above. As one example, the following modified examples can be employed.

First Modified Example

Although a plurality of printing media 22 are spaced apart from each other by a fixed gap and attached on the mount 21 to form the continuous sheet 20 in the embodiment described above, the width of the gap between adjacent printing media 22 is not necessarily required to be fixed. In such a case, the distance to reverse-transport during reverse transport control may be set to a fixed distance that is greater than the maximum value of the gap width between the printing media 22.

Second Modified Example

Further, the distance to reverse-transport during reverse transport control may not necessarily be required to be a fixed distance. For example, the continuous sheet 20 may be reverse-transported until a detection value that becomes lower than the maximum value by a predetermined value or more is acquired by the transmission sensor 73. In such a case, the transporting distance before a detection value that is lower than the maximum value by a predetermined value or more is acquired corresponds to a reverse-feed distance. According to such a configuration, the flexibility of the gap width L1 may be increased. Note that, in such a case, the distance to reverse-transport may be slightly greater than a transporting distance before a detection value that is lower than the maximum value by a predetermined value or more is acquired. Further, the fixed value may be the same as or different from the threshold of 25% used when the head position of the printing medium 22 is detected.

Third Modified Example

Although the control unit 110 determines that the head position of the printing medium 22 is detected when a detection value that is lower than the maximum value by 25% or more in the embodiment described above, the threshold of 25% can be changed in accordance with the product specification of the printer device 1 if necessary. Further, when the type of the continuous sheet 20 can be set in the printer device 1, the threshold used for determining detection of the head position can be changed in accordance with the set type of the continuous sheet 20.

Fourth Modified Example

Although the transmission sensor 73 is adjusted by adjusting the output of the transmission sensor light-receiving unit 73*b* in the embodiment described above, the transmission sensor 73 may be adjusted by adjusting the output of the transmission sensor light-emitting unit 73*a*. In such a case, adjustment of the output of the transmission sensor light-emitting unit 73*a* is one example of first adjustment of a detection unit.

Fifth Modified Example

Alternatively, instead of the transmission sensor 73 is adjusted during calibration, the control unit 110 may adjust the first threshold that is a threshold used for determining that the printing medium 22 is detected. In such a case, adjustment of the first threshold is one example of the first adjustment of a detection unit.

Sixth Modified Example

Although the continuous sheet 20 fed out from the roll sheet 100 has been illustrated in the embodiment described above, the continuous sheet 20 may be a fanfold sheet.

Seventh Modified Example

The scope of the disclosure includes a method of performing each process of the printer device 1 illustrated in the embodiment and each modified example described above, a program used for performing each process, and a computer readable storage medium storing the program. In addition, modification is possible if necessary without departing from the spirit of the disclosure.

Supplementary Notes

Supplementary notes for a printer device and a control method of the printer device will be provided below.

The printer device 1 includes a transport mechanism 40 that transports a continuous sheet in which a plurality of printing media 22 are spaced apart from each other by a gap and attached on a mount 21, the transmission sensor 73 having the transmission sensor light-emitting unit 73*a* that emits light to the continuous sheet 20 and the transmission sensor light-receiving unit 73*b* that receives light transmitted through the continuous sheet 20, and a control unit 110 that adjusts the transmission sensor 73. The control unit 110 transports the continuous sheet 20 in the transport direction by using the transport mechanism 40, performs reverse transport control to transport the continuous sheet 20 in a direction opposite to the transport direction by a reverse-feed distance that is greater than the gap by using the transport mechanism 40 when the head position of a printing medium 22 is detected by the transmission sensor 73, and adjusts the transmission sensor 73 after the reverse transport control.

A control method of the printer device 1 is a method of controlling the printer device 1. The printer device 1 includes a transport mechanism 40 that transports a continuous sheet in which a plurality of printing media 22 are spaced apart from each other by a gap and attached on a mount 21 and the transmission sensor 73 having the transmission sensor light-emitting unit 73*a* that emits light to the continuous sheet 20 and the transmission sensor light-receiving unit 73*b* that receives light transmitted through the continuous sheet 20, and the printer device 1 is configured to adjust the transmission sensor 73. The control method includes transporting the continuous sheet 20 in the transport direction by using the transport mechanism 40, performing reverse transport control to transport the continuous sheet 20 in a direction opposite to the transport direction by a reverse-feed distance that is greater than the gap by using the transport mechanism 40 when the head position of a printing medium 22 is detected by the transmission sensor 73, and adjusting the transmission sensor 73 after the reverse transport control.

According to the above configuration, the printer device 1 transports the continuous sheet 20 in the transport direction, detects the head position of the printing medium 22 by using the transmission sensor 73, transports the continuous sheet 20 in a direction opposite to the transport direction by a reverse-feed distance that is greater than the gap by using the transport mechanism 40, and then adjusts the transmission sensor 73. It is therefore possible to adjust the transmission sensor 73 by using a detection value detected avoiding the head position of the printing medium 22. Accordingly, even when the continuous sheet 20 on which the black mark BM is printed is used, it is possible to accurately adjust the sensitivity of the transmission sensor 73 while avoiding detecting the print position of the black mark BM.

In the printer device 1 described above, the control unit 110 may transport the continuous sheet 20 in the direction opposite to the transport direction in response to acquiring a second detection value that is lower than a first detection value by a predetermined value or more after starting transporting the continuous sheet 20 in the transport direction and then acquiring the first detection value by using the transmission sensor 73.

According to the above configuration, the printer device 1 may accurately detect the head position of the printing medium 22.

In the printer device 1 described above, the mount 21 may have a black mark BM associated with the position of the printing medium 22 in the transport direction of the continuous sheet 20, and the control unit 110 may perform reverse transport control in response to detecting the head position of the black mark BM by using the transmission sensor 73 after starting transporting the continuous sheet 20 in the transport direction.

According to the above configuration, the printer device 1 may accurately adjust the transmission sensor 73 in accordance with the head position of the printing medium 22 even when the continuous sheet 20 on which the black mark BM is printed on the mount 21 is used.

The printer device 1 described above may further include a reflection sensor 71 having a reflection sensor light-emitting unit 71*a* that emits light to the continuous sheet 20 and a reflection sensor light-receiving unit 71*b* that receives light reflected by the continuous sheet 20, and the transmission sensor 73 and the reflection sensor 71 may be arranged to be aligned in the transport direction of the continuous sheet 20.

According to the above configuration, even in the printer device 1 in which the transmission sensor 73 and the reflection sensor 71 are not arranged to be aligned in the width direction of the continuous sheet 20, the transmission sensor 73 may be accurately adjusted.

In the printer device 1 described above, the control unit 110 may transport the continuous sheet 20 in the direction opposite to the transport direction until the second detection value is acquired by the transmission sensor 73 in the reverse transport control.

According to the above configuration, in the reverse transport control, since the continuous sheet 20 is reverse-transported until the second detection value is acquired, the gap width in the transport direction of the continuous sheet 20 of the printing medium 22 may be flexibly set.

What is claimed is:

1. A printer device comprising:

a transport mechanism configured to transport, from a roll sheet including a continuous sheet being a wound form in a roll, the continuous sheet including a mount and a plurality of printing media attached to the mount and spaced apart from each other by a gap;

a first detection unit including a first light-emitting unit configured to emit light to the continuous sheet and a first light-receiving unit configured to receive light transmitted through the continuous sheet; and a control unit configured to adjust the first detection unit, wherein the control unit configured to perform the following:

start transporting the continuous sheet in a transport direction, transport the continuous sheet in a direction opposite to the transport direction by a reverse-feed distance that is greater than the gap when a printing medium of the continuous sheet reaches a detection position of the first detection unit after the gap of the continuous sheet passes by the detection position of the first detection unit, and start adjusting the first detection unit through a portion of the printing media reaching the detection position of the first detection unit after transporting the continuous sheet in the direction opposite to the transport direction.

2. The printer device according to claim 1, wherein the mount has a black mark associated with each of the printing media on the continuous sheet, and the control unit transports the continuous sheet in the direction opposite to the transport direction when a head position of the black mark is detected by the first detection unit after starting transporting the continuous sheet in the transport direction.

3. The printer device according to claim 1 further comprising a second detection unit having a second light-emitting unit that emits light to the continuous sheet and a second light-receiving unit that receives light reflected by the continuous sheet, wherein the first detection unit and the second detection unit are arranged to be aligned in the transport direction of the continuous sheet.

4. The printer device according to claim 1, wherein the control unit transports the continuous sheet in the direction opposite to the transport direction in response to acquiring a second detection value that is lower than a first detection value by a predetermined value or more after starting transporting the continuous sheet in the transport direction and then acquiring the first detection value by using the first detection unit.

5. The printer device according to claim 4, wherein when transporting the continuous sheet in the direction opposite to the transport direction, the control unit transports the continuous sheet in the direction opposite to the transport direction until the second detection value is acquired by the first detection unit.

6. A control method of a printer device including a transport mechanism configured to transport, from a roll sheet including a continuous sheet being a wound form in a roll, the continuous sheet including a mount and a plurality of printing media attached to the mount and spaced apart from each other by a gap, and a first detection unit including a first light-emitting unit configured to emit light to the continuous sheet and a first light-receiving unit configured to receive light transmitted through the continuous sheet, and the control method comprising:

starting transporting the continuous sheet in a transport direction;

transporting the continuous sheet in a direction opposite to the transport direction by a reverse-feed distance that is greater than the gap when a printing medium of the continuous sheet reaches a detection position of the first detection unit after the gap of the continuous sheet passes by the detection position of the first detection unit; and starting adjusting the first detection unit through a portion of the printing media reaching the detection position of the first detection unit after transporting the continuous sheet in the direction opposite to the transport direction.

* * * * *